US009158242B2

(12) United States Patent
Saito

(10) Patent No.: US 9,158,242 B2
(45) Date of Patent: Oct. 13, 2015

(54) IMAGE FORMING APPARATUS

(71) Applicant: CANON FINETECH INC., Misato-shi, Saitama-ken (JP)

(72) Inventor: Kengo Saito, Nagareyama (JP)

(73) Assignee: Canon Finetech Inc., Misato-shi (JP)

( * ) Notice: Subject to any disclaimer, the term of this patent is extended or adjusted under 35 U.S.C. 154(b) by 45 days.

(21) Appl. No.: 13/682,912

(22) Filed: Nov. 21, 2012

(65) Prior Publication Data

US 2013/0136466 A1 May 30, 2013

(30) Foreign Application Priority Data

Nov. 30, 2011 (JP) ..... 2011-262948

(51) Int. Cl.
*G03G 15/18* (2006.01)
*G03G 15/00* (2006.01)
*G03G 15/16* (2006.01)

(52) U.S. Cl.
CPC ..... *G03G 15/18* (2013.01); *G03G 15/1675* (2013.01); *G03G 15/553* (2013.01)

(58) Field of Classification Search
CPC .. G03G 15/1675; G03G 15/553; G03G 15/18
USPC ..... 399/31, 66, 310, 314
See application file for complete search history.

(56) References Cited

U.S. PATENT DOCUMENTS 5,631,725 A * 5/1997 Harasawa et al. ..... 399/66
6,205,299 B1 * 3/2001 Kusaka et al. ..... 399/45
7,106,984 B2 9/2006 Katsumi
7,742,712 B2 6/2010 Izumi
2005/0281569 A1 * 12/2005 Nishimura ..... 399/31
2007/0003300 A1 * 1/2007 Takahashi ..... 399/44
2008/0088883 A1 4/2008 Yoshida

FOREIGN PATENT DOCUMENTS

CN 1542566 A 11/2004
CN 101236375 A 8/2008
JP 7-146619 A 6/1995

(Continued)

OTHER PUBLICATIONS

Notification of Reason for Refusal dated Sep. 10, 2013, in Japanese Application No. 2011-262948.

(Continued)

*Primary Examiner* — Rodney Bonnette
(74) *Attorney, Agent, or Firm* — Fitzpatrick, Cella, Harper & Scinto

(57) ABSTRACT

An image forming apparatus, including: an image bearing member; a transfer member to which a transfer voltage is applied to transfer the toner image on the image bearing member to a recording medium; a transfer voltage applying unit configured to apply the transfer voltage to the transfer member to make a value of a current flowing through the transfer member into a set current value; and a control unit configured to control the transfer voltage applying unit by changing stepwise the set current value according to a resistance of the transfer member, wherein the control unit sets a set current value smaller than a target current value when a target voltage value is larger than a preset threshold voltage value, the target current value being set according to the resistance of the transfer member, the target voltage value being applied to flow a current of the target current value.

10 Claims, 4 Drawing Sheets

| | | THRESHOLD VALUE |
|---|---|---|
| 15°C/10% | (V) | 6000 |
| | (μA) | 30 |
| 23°C/50% | (V) | 4500 |
| | (μA) | 20 |
| 30°C/80% | (V) | 2000 |
| | (μA) | 10 |

(56) References Cited

FOREIGN PATENT DOCUMENTS

| | | | |
|---|---|---|---|
| JP | 2003-195700 | A | 7/2003 |
| JP | 2008-96687 | A | 4/2008 |

OTHER PUBLICATIONS

Office Action in Chinese Patent Application No. 201210505762.8, dated Nov. 18, 2014.

* cited by examiner

FIG. 4

| | | THRESHOLD VALUE A | THRESHOLD VALUE B | THRESHOLD VALUE C | THRESHOLD VALUE D |
|---|---|---|---|---|---|
| 15°C/10% | (V) | 4200 | 4400 | 4600 | 4800 |
| | (μA) | 29 | 28 | 27 | 26 |
| 23°C/50% | (V) | 1700 | 1900 | 2100 | 2300 |
| | (μA) | 20 | 19 | 18 | 17 |
| 30°C/80% | (V) | 700 | 900 | 1100 | 1300 |
| | (μA) | 9 | 8 | 7 | 6 |

FIG. 5

| | | THRESHOLD VALUE |
|---|---|---|
| 15°C/10% | (V) | 6000 |
| | (μA) | 30 |
| 23°C/50% | (V) | 4500 |
| | (μA) | 20 |
| 30°C/80% | (V) | 2000 |
| | (μA) | 10 |

IMAGE FORMING APPARATUS

BACKGROUND OF THE INVENTION

1. Field of the Invention

The present invention relates to an image forming apparatus such as a copying machine, a printer, and a facsimile machine configured to form an image by an electrophotographic method or an electrostatic recording method.

2. Description of the Related Art

In the image forming apparatus employing an electrophotographic method or an electrostatic recording method, a toner image formed on a surface of a photosensitive drum is transferred onto a sheet as a recording medium so that the image is recorded on the sheet. In general, as for the transfer of the toner image, toner on the surface of the photosensitive drum is electrostatically transferred onto the sheet by an application of a bias to a transfer roller while the sheet is conveyed by being nipped between the photosensitive drum and the transfer roller.

A method of applying a bias to the transfer roller includes a constant voltage control method and a constant current control method. The constant voltage control method is a method of applying a transfer bias so that a voltage to be applied is maintained at a constant value. The constant voltage control method has been conventionally widely used. However, according to the constant voltage control method, in a case of small-sized sheets, a current flows intensively through a region in which the transfer roller is in direct contact with the photosensitive drum, and hence a current cannot be sufficiently supplied to the small sheets so that a transfer failure may occur.

In contrast, according to the constant current control method, the transfer bias is applied so that a constant current flows through a sheet irrespective of a size of the sheet, and the current is compensated when the size of the sheet is small. Under the circumstance, in recent years, the constant current control method has been more widely used as the method of applying a transfer bias. In the constant current control method, it is necessary to set a voltage for passing a constant current through the transfer roller. Thus, conventionally, a constant current, which is supposed to flow at the time of transfer, is flowed through the transfer roller at a time of non-image formation, specifically, prior to the start of an image forming operation, and a voltage applied at that time is maintained and applied at a time of image formation (Japanese Patent Application Laid-Open No. H07-146619).

However, an electric resistance of the transfer roller varies depending on an environment (temperature and humidity) in which the image forming apparatus is installed and a long-term use. In extreme cases, a value of the electric resistance may fluctuate by an order of magnitude or more. Thus, when the resistance of the transfer roller is higher than usual, a voltage to be applied to flow a target current also increases. When the voltage to be applied exceeds a predetermined value, a separation electric-discharge phenomenon occurs near a nip between the photosensitive drum and the transfer roller. The separation electric-discharge occurs when a sum of a strength E1 of an electric field between the photosensitive drum and a sheet and a strength E2 of an electric field between the transfer roller and the sheet exceeds a strength Em of a discharge start electric field. In particular, the separation electric-discharge is liable to occur when a high voltage is applied to the transfer roller. When the separation electric-discharge occurs, toner transferred on the sheet is scattered so that the scattered toner may pose a problem of griming an inside of a main body of the image forming apparatus.

However, when the voltage to be applied is kept as low as possible in order to prevent occurrence of the separation electric-discharge, the current flowing through the sheet at the time of transfer becomes smaller, which may cause transfer failure of the toner.

SUMMARY OF THE INVENTION

The present invention has been made in view of the above-mentioned problems. The present invention provides an image forming apparatus configured to apply a transfer bias while suppressing not only occurrence of the separation electric-discharge phenomenon but also occurrence of the transfer failure even when a resistance of a transfer member varies.

According to an exemplary embodiment of the present invention, there is provided an image forming apparatus, including: an image bearing member on which a toner image is to be formed; a transfer member to which a transfer voltage is to be applied so that the toner image on the image bearing member is transferred onto a recording medium; a transfer voltage applying unit configured to apply the transfer voltage to the transfer member so that a value of a current flowing through the transfer member reaches a set current value; and a control unit configured to control the transfer voltage applying unit by changing the set current value in accordance with a resistance of the transfer member, wherein the control unit sets the set current value to a value smaller than a target current value when a target voltage value is larger than a preset threshold voltage value, the target current value being a current value which is set in accordance with the resistance of the transfer member, the target voltage value being a value of a voltage which is applied to flow a current of the target current value.

Further features of the present invention will become apparent from the following description of exemplary embodiments with reference to the attached drawings.

BRIEF DESCRIPTION OF THE DRAWINGS

FIG. 4 is a table of threshold values.

FIG. 5 is a table of threshold values indicating an end-of-life of a transfer roller.

DESCRIPTION OF THE EMBODIMENT

In the following, an image forming apparatus according to an embodiment of the present invention will be described with reference to the accompanying drawings.

Figure 1:
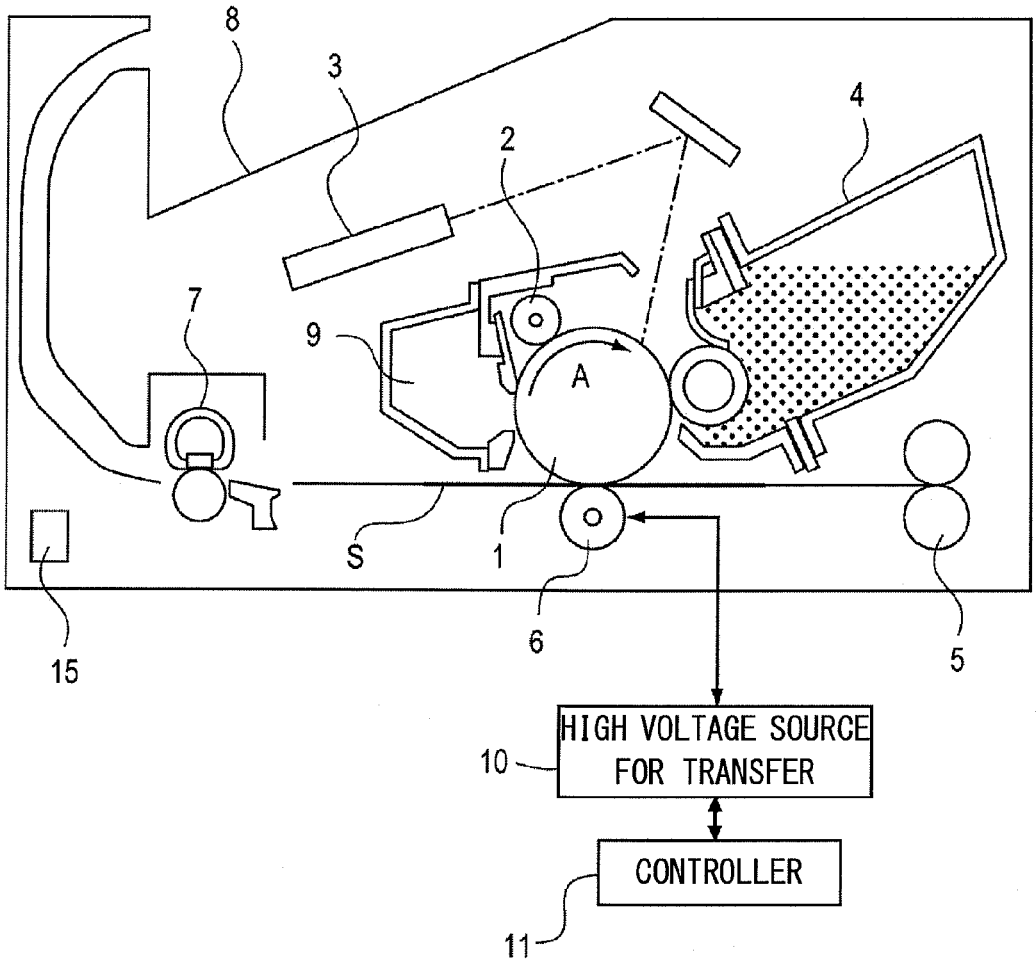
FIG. 1 is a schematic structural view of an image forming apparatus according to an embodiment of the present invention.

FIG. 1 is a schematic structural view of the image forming apparatus according to the embodiment of the present invention. The image forming apparatus according to the embodiment is an electrophotographic laser beam printer.

<Overall Structure of Image Forming Apparatus>

An overall structure of the image forming apparatus will be described along with an image forming operation. As for image formation, a drum-shaped electrophotographic photosensitive member (hereinafter referred to as "photosensitive drum") 1 as an image bearing member is driven to rotate in a direction (clockwise direction) indicated by the arrow A in FIG. 1. A surface of the electrophotographic photosensitive member is uniformly charged by a charging roller 2. Then, the charged surface of the photosensitive drum 1 is exposed to a laser beam from an exposure device 3 so that an electrostatic latent image according to input image information is formed. The electrostatic latent image is developed into a toner image by a developing device 4.

In synchronism with the toner image formation, a sheet S as a recording medium is fed from a cassette (not shown) by a feeding unit, and conveyed into a transfer portion by a conveying roller pair 5. The transfer portion is a nip formed by the photosensitive drum 1 and a transfer roller 6 as a transfer member. While the sheet S is nipped and conveyed by the photosensitive drum 1 and the transfer roller 6, a transfer bias is applied to the transfer roller so that the toner image on the surface of the photosensitive drum 1 is transferred onto the sheet S.

Then, the sheet S on which the toner image has been transferred is conveyed to a fixing device 7 in which the toner image is fixed by thermal fixation. After that, the sheet S is delivered onto a delivery portion 8. Further, untransferred residual toner remaining on the surface of the photosensitive drum 1 after the toner image is transferred is removed and collected by a cleaning device 9.

<Transfer System>

Next, a transfer system according to the embodiment will be described specifically.

(Transfer Roller)

The transfer roller 6 is brought into contact with the surface of the photosensitive drum 1 at a predetermined pressure by a pressure spring (not shown) to form a transfer nip. With the transfer bias, which is applied from a high voltage source 10 for transfer as a bias applying unit, the toner image on the surface of the photosensitive drum 1 is transferred onto the sheet S at the transfer nip between the photosensitive drum 1 and the transfer roller 6. The bias application performed by the high voltage source 10 for transfer is driven and controlled by a controller 11 as a control unit.

The transfer roller 6 according to the embodiment includes a rubber roller formed of a solid (filling-fleshy) or foamed sponge-like medium-resistance elastic layer made of ethylene propylene diene monomer (EPDM) rubber, silicone rubber, nitrile-butadiene rubber (NBR), or urethane rubber, which is applied around a core made of iron or stainless steel (SUS). Further, the transfer roller 6 used in the embodiment has a roller hardness of from 25 to 70 (Asker-C hardness under a load of 500 g) and an electric resistance of from $10^5\Omega$ to $10^{10}\Omega$.

(How to Control Application of Transfer Bias)

Figure 2:
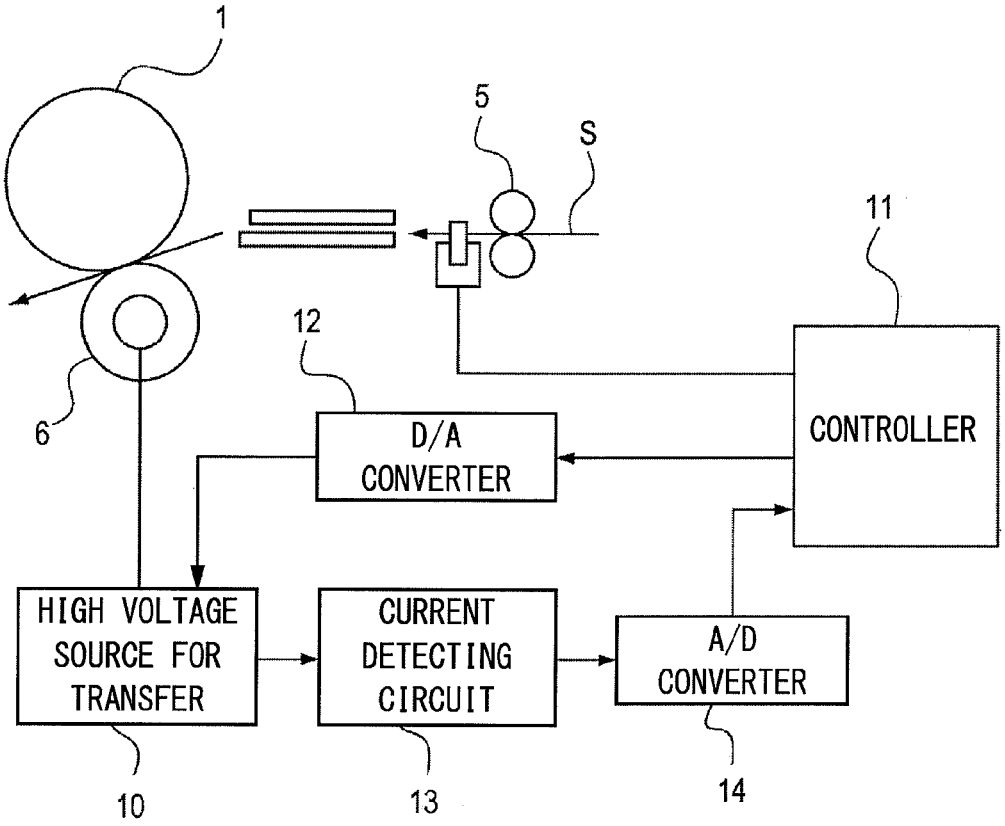
FIG. 2 is a block diagram of a transfer bias control system.

Next, how to control the application of the transfer bias to the transfer roller 6 will be described. FIG. 2 is a block diagram of a control system configured to apply the transfer bias to the transfer roller 6.

In FIG. 2, the controller 11 controls the entire apparatus. Specifically, the controller 11 controls the image forming operation, the transfer bias, and density of an image. When the transfer bias is controlled by the controller 11, a pulse width modulation (PWM) signal having a pulse width corresponding to a desired transfer output voltage is output from an OUT terminal. Actually, a transfer output table (not shown) corresponding to the pulse width is stored (memorized) in advance in the controller 11. The PWM signal is input to the high voltage source 10 for transfer via a D/A converter 12. A voltage corresponding to a value of the PWM signal is output as a transfer voltage to be applied to the transfer roller 6. A value of a current flowing at this time is detected by a current detecting circuit 13, and then converted into a digital signal by an A/D converter 14. After that, the digital signal is input to an IN terminal of the controller 11. In this way, the value of the current flowing through the transfer roller 6 is determined.

Then, in the embodiment, the application of the transfer bias is controlled by constant current control. The constant current control is performed by continuing to gradually increase the pulse width of the PWM signal output from the controller 11 until the signal input to the IN terminal of the controller 11 reaches a value corresponding to a desired set current value (constant current value), and causing a voltage (pulse width) to follow subsequent changes in current value.

Next, a procedure of setting the set current value for performing the constant current control will be described. In order to apply a transfer bias by the constant current control, a current of a target current value to be flowed at the time of transfer is flowed through the transfer roller 6, and a voltage applied at this time is maintained and applied to the transfer roller 6 as a bias voltage at the time of transfer. However, as described above, the resistance of the transfer roller 6 varies depending on an environment (temperature and humidity) in which the image forming apparatus is installed and a long-term use.

Here, on a premise that the target value of the current to be flowed through the transfer roller 6 irrespective of the resistance of the transfer roller 6 so as to transfer the toner image onto the sheet S is a target current value, and that a target value of the voltage to be applied to the transfer roller 6 so as to flow the current of the target current value is a target voltage value, the target voltage value fluctuates in accordance with change in the resistance of the transfer roller 6 when the target current value is kept constant.

However, as described above, when an excessively high voltage is applied to the transfer roller 6, separation electric-discharge occurs, which may cause toner scattering. Meanwhile, when an excessively low voltage is applied to the transfer roller 6, the current to be flowed through the transfer roller 6 is small, which may cause transfer failure.

As a countermeasure, in the embodiment, when the target voltage value corresponding to the resistance of the transfer roller 6 is larger than a preset threshold value, the controller 11 controls the set current value, which is set as a constant current to be flowed for performing the constant current control, to become smaller in a stepwise manner than the target current value.

Figure 3:
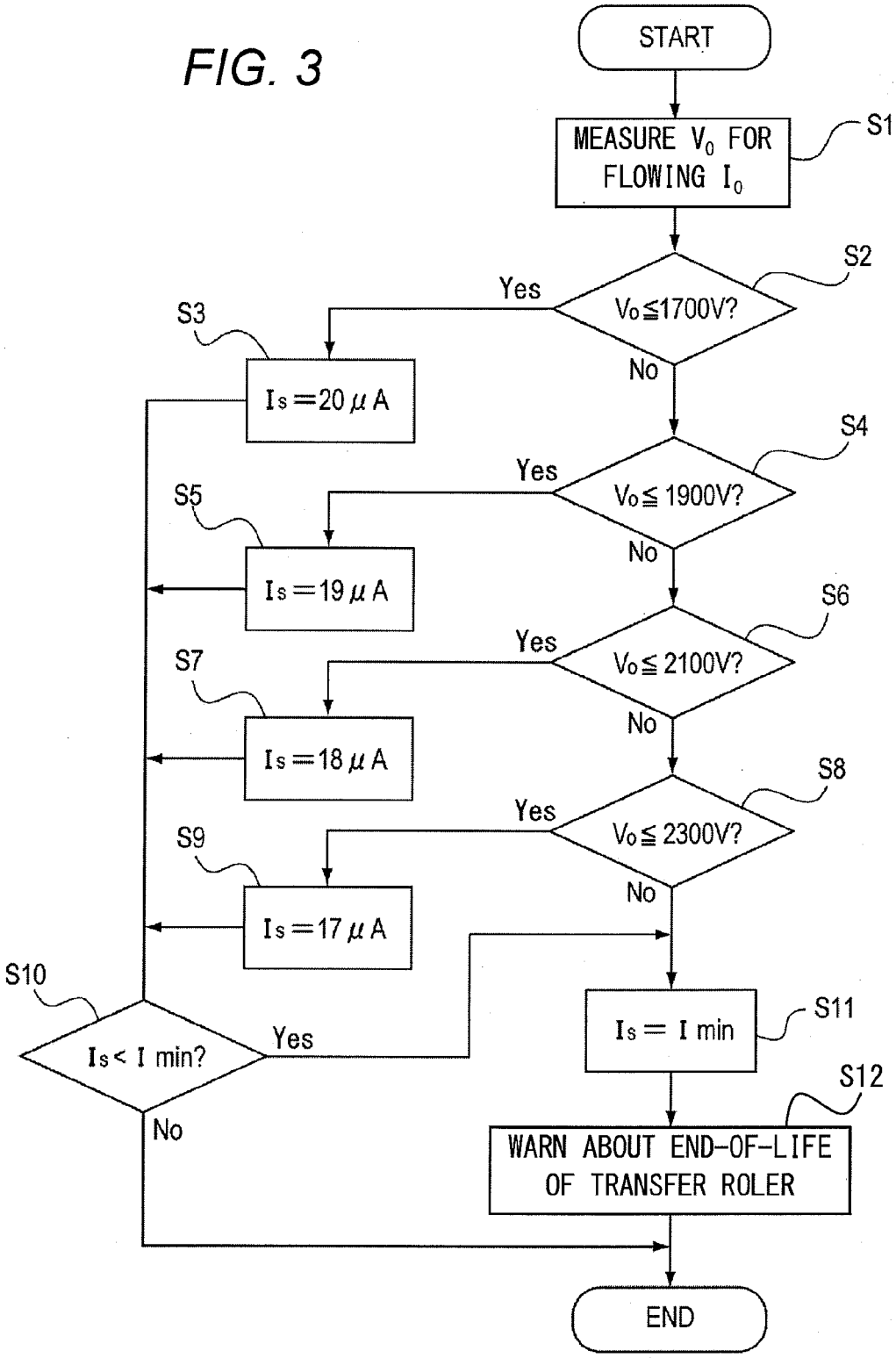
FIG. 3 is a flowchart illustrating a transfer bias control procedure.

A procedure of setting the set current value will be described specifically with reference to the flowchart of FIG. 3.

The image forming apparatus according to the embodiment includes an environment detecting sensor 15 (refer to FIG. 1) configured to detect temperature and humidity in the apparatus. Further, the image forming apparatus includes a setting table containing stepwise threshold voltage values which are compared to the target voltage value when the transfer bias is applied in accordance with the temperature and the humidity in the apparatus. The setting table defines set current values set correspondingly to threshold voltage values (threshold values A to D) which are set in a stepwise manner, as shown, for example, in FIG. 4, and those set current values are set correspondingly to each of the following apparatus environments: a low temperature and low humidity environment (for example, temperature of 15° C. and humidity of 10%); a normal environment (for example, temperature of 23° C. and humidity of 50%); and a high temperature and high humidity environment (for example, temperature of 30° C. and humidity of 80%).

The set current values are set as follows. First, the temperature and the humidity in the image forming apparatus, which are detected by the environment detecting sensor 15, are classified into (1) high temperature and high humidity environment, (2) normal environment, and (3) low temperature and low humidity environment. Then, the resistance of the transfer roller 6 is calculated based on currents flowing through application of voltages set correspondingly to each of the environments. Then, based on the resistance, a target voltage value $V_o$ for flowing a current of a target current value $I_o$ is calculated (Step S1).

Then, the target voltage value $V_o$ is compared to threshold voltage values $V_S$ defined in the setting table, and the target current value $I_o$ is adjusted to a set current value $I_s$ defined in accordance with the corresponding threshold voltage value.

For example, with reference to the setting table shown in FIG. 4, in the image forming apparatus according to the embodiment, in the normal environment, the target current value $I_o$ of the current to be flowed through the transfer roller 6 by the constant current control method is 20 (μA). Further, in the embodiment, a transfer bias to generate the separation electric-discharge start electric field is set to be somewhat larger than 1,700 V, and hence the separation electric-discharge does not occur even when a voltage of 1,700 V is applied as the transfer bias.

Thus, when the target voltage value $V_o$ of the voltage to be applied to flow the current of the target current value $I_o$ of 20 (μA) through the transfer roller 6 having the resistance calculated as described above satisfies $V_o \leq 1{,}700$ (V), the set current value $I_s$ is set to 20 (μA) so that a current corresponding to the target current value $I_o$ is flowed as it is (Steps S2 and S3).

Meanwhile, when the resistance of the transfer roller 6 is high, and the target voltage value $V_o$ of the voltage to be applied to flow the current of the target current value $I_o$ of 20 (μA) falls within a range of 1,700 (V)$<V_o \leq$1,900 (V), the separation electric-discharge may occur if the voltage corresponding to the target voltage value $V_o$ without change is applied. As a countermeasure, in that case, the set current value $I_s$ is set to be smaller than the target current value $I_o$ by 1 (μA), that is, set to 19 (μA) (Steps S4 and S5).

Further, when the target voltage value $V_o$ falls within a range of 1,900 (V)$<V_o \leq$2,100 (V), and a voltage corresponding to the target voltage value $V_o$ without change is applied, the separation electric-discharge is more liable to occur. As a countermeasure, the set current value $I_s$ is set to be smaller than the target current value $I_o$ by 2 (μA), that is, set to 18 (μA) (Steps S6 and S7).

Similarly, when the target voltage value $V_o$ falls within a range of 2,100 (V)$<V_o \leq$2,300 (V), the set current value $I_s$ is set to be smaller than the target current value $I_o$ by 3 (μA), that is, set to 17 (μA) (Steps S8 and S9).

Note that, when the set current value $I_s$ set in each of Steps S3, S5, S7, and S9 described above is smaller than a lower limit current value $I_{min}$ that has been preset as a lower limit value, the transfer failure may occur. As a countermeasure, it is determined whether or not the set current value $I_s$ is smaller than the lower limit current value $I_{min}$ (Step S10). When $I_s<I_{min}$ is established, the set current value $I_s$ is reset to be equal to the lower limit current value $I_{min}$ (Step S11). The set current value $I_s$ is not set to be smaller than the lower limit current value $I_{min}$. In other words, the set current value $I_s$ is set to be equal to or larger than the lower limit current value $I_{min}$. Note that, in the embodiment, the lower limit current value $I_{min}$ is set to be equal to 16 (μA).

Further, when the target voltage value $V_o$ satisfies 2,300 (V)$<V_o$, the set current value $I_s$ is set to be smaller than the target current value $I_o$ by 4 (μA), that is, set to 16 (μA) equal to the lower limit current value $I_{min}$ (Step S11).

Then, when the set current value $I_s$ is set to the lower limit current value $I_{min}$, it is determined that the resistance of the transfer roller 6 is higher than the preset value, as a result it is discriminated that the transfer roller 6 has reached the end of its life. In this case, as described below, the end-of-life of the transfer roller 6 is warned about by a warning unit (Step S12).

As described above, when the target voltage value $V_o$ of the voltage to be applied to flow the current of the target current value $I_o$ is larger than the preset threshold voltage value owing to an increase of the resistance of the transfer roller 6, the set current value for the constant current control is adjusted to be smaller than the target current value $I_o$. With this, separation electric-discharge can be effectively suppressed near the nip portion between the photosensitive drum 1 and the transfer roller 6, to thereby prevent the inside of the image forming apparatus from being begrimed by scattered toner. In addition, when the set current value is set equal to or larger than the lower limit current value $I_{min}$ below which transfer failure of the toner image may occur, the transfer failure can also be suppressed.

(Timing of Setting Set Current Value)

The value of the voltage to be applied to flow the current of the set current value $I_s$, which is calculated as described above, through the transfer roller is stored in a memory so that a transfer bias of the stored value is applied at the time of image formation. In the image forming apparatus according to the embodiment, settings of the set current and the corresponding voltage are stored at the time of a post-processing (post-rotation) operation in the image forming apparatus. When the settings are performed at the time of the post-processing operation after the image formation, the transfer bias in accordance with the resistance of the transfer roller 6 has already been set at the start of subsequent image formation. Thus, a first print out time is reduced. Further, at the time of the post-processing operation, a certain time period can be secured after completion of the image formation, and hence the threshold voltage values can be set in a larger number of steps so that the set current values $I_s$ are more finely set.

Alternatively, the threshold voltage value may vary linearly or as a curve. The set current value may vary linearly or as a curve in accordance with the threshold voltage value which varies linearly or as a curve.

Note that, the settings of the set current and the corresponding voltage may be stored at the time of a pre-processing (pre-rotation) operation in the image forming apparatus, in other words, at the time of a pre-processing operation immediately before the start of the image formation. In this case, the first print out time is somewhat longer, but a set current can be set in accordance with an apparatus environment at the time of image formation (the resistance of the transfer roller 6, which is substantially equal to that at the time of image formation). When the set current is set at the time of the pre-processing operation, it is appropriate to reduce the number of steps of the threshold voltage values $V_S$ to be set. Specifically, it is appropriate to reduce the number of processing steps by reducing the set current value $I_s$ not by 1 (μA) as in the embodiment but by 3 (μA), to thereby reduce a delay of the first print out time.

In the case that the settings of the set current and the corresponding voltage are stored at the time of the post-processing operation, the stored transfer bias value is used for subsequent image formation. In this context, when a long time period elapses between the completion of image formation and the subsequent image formation, the apparatus environment at the time when the settings are stored may be different from that at the time of the subsequent image formation.

As a countermeasure, when a predetermined time period or longer elapses between the completion of image formation and the subsequent image formation, data of the settings stored at the time of the post-processing operation after the completion of previous image formation may be deleted and new settings may be stored at the time of a pre-processing operation in the subsequent image formation.

(Discrimination of End-of-Life of Transfer Roller)

The image forming apparatus according to the embodiment includes the warning unit configured to warn about the end-of-life of the transfer roller 6.

As described above, the transfer roller 6 according to the embodiment is a rubber roller made of silicone rubber or urethane rubber applied on the core. Thus, the electric resistance is not only changed by the apparatus environment, but also becomes higher along with deterioration over time. As a result, when the resistance of the transfer roller 6 is higher than a resistance corresponding to the end-of-life of the transfer roller 6, in the procedure of setting the set current value $I_S$, the target voltage value $V_o$ to be applied to flow the current of the target current value $I_o$ is markedly large. Therefore, when the target voltage value $V_o$ is larger than the threshold voltage value $V_S$, which is set as a life threshold value, it can be discriminated that the transfer roller 6 has reached its end-of-life.

In the embodiment, as shown, for example, in FIG. 5, there is provided a life discriminating table of threshold voltage values to be compared to the target voltage value $V_o$ of the voltage to be applied to flow the current of the target current value $I_o$ when a resistance, based on which it is discriminated in accordance with the apparatus environment that the transfer roller 6 has reached its end-of-life, is detected. When the target voltage value $V_o$ larger than the life threshold voltage value is detected at the time of setting the transfer bias value, the warning unit warns about the end-of-life of the transfer member 6.

The warning unit includes a display unit configured to display that the transfer roller 6 has reached its end-of-life. Note that, when the image forming apparatus is connected to a network, a notification that the transfer roller 6 requires maintenance may be sent.

The image forming apparatus according to the embodiment includes a setting table in which the threshold voltage values are stepwise set in accordance with the temperature and the humidity in the apparatus. However, the invention is not limited thereto. The image forming apparatus may include a setting table in which a threshold value varies linearly or as a curve in accordance with the temperature and the humidity in the apparatus.

When the target voltage value corresponding to the resistance of the transfer roller is larger than the threshold voltage value, the controller controls the set current value, which is set as a constant current to be flowed for performing the constant current control, to become smaller linearly or as a curve than the target current value.

According to the embodiment, the value of the current to be flowed through the transfer member at the time of transfer is changed in accordance with the resistance of the transfer member. With this, a current value to apply a voltage at which a separation electric-discharge phenomenon or transfer failure does not occur can be set.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-262948, filed Nov. 30, 2011, which is hereby incorporated by reference herein in its entirety.

What is claimed is:

1. An image forming apparatus, comprising:

an image bearing member on which a toner image is to be formed;

a transfer member configured to transfer the toner image on the image bearing member onto a recording medium;

a transfer voltage applying unit configured to apply a target voltage value to the transfer member so that a value of a current flowing through the transfer member reaches a set current value; and a control unit configured to change the set current value to a smaller current value when the target voltage value is larger than a predetermined voltage value at a time of a pre-processing operation before an image formation or at a time of a post-processing operation after the image formation, the control unit configured to control the transfer voltage applying unit so that the transfer voltage applying unit applies a transfer voltage for transferring the toner image on the image bearing member onto the recording medium based on the target voltage value.

2. An image forming apparatus according to claim 1, wherein the control unit sets the set current value to be equal to or larger than a value preset as a lower limit value.

3. An image forming apparatus according to claim 1, wherein the predetermined voltage value is a preset threshold voltage value, and the control unit includes a setting table containing set threshold voltage values which are compared to the target voltage value, and the control unit changes the set current value in accordance with the target voltage value and based on the setting table.

4. An image forming apparatus according to claim 1, wherein the control unit sets again the set current value, which has been changed to the smaller current value, in accordance with change in temperature and humidity in the image forming apparatus.

5. An image forming apparatus according to claim 1, further comprising a warning unit, wherein the control unit controls the warning unit to warn that the transfer member has reached an end-of-life of the transfer member when the target voltage value is higher than a life threshold value.

6. An image forming apparatus, in which a formed toner image is transferred by a transfer voltage applied to a transfer member, comprising:

a transfer voltage applying unit configured to apply a target voltage value to the transfer member so that a value of a current flowing through the transfer member reaches a predetermined current value and to change the predetermined current value to a smaller current value in a case where the target voltage value exceeds a predetermined voltage value at a time of a pre-processing operation before an image formation or at a time of a post-processing operation after the image formation.

7. An image forming apparatus according to claim 6, wherein the predetermined current value is a preset constant current value.

8. An image forming apparatus according to claim 6, wherein the target voltage value is a value of a voltage to be applied to cause a flow of the current of the predetermined current value in accordance with a value of resistance obtained from a value of the current flowing through the transfer member.

9. An image forming apparatus according to claim 6, wherein when the predetermined current value is changed, the predetermined current value is not changed to a current value smaller than a value preset as a lower limit value.

10. An image forming apparatus according to claim 6, wherein when the predetermined current value is changed, the predetermined current value is changed in a stepwise manner.

* * * * *